US009103146B2

(12) United States Patent
Morinaga

(10) Patent No.: US 9,103,146 B2
(45) Date of Patent: Aug. 11, 2015

(54) VEHICLE DOOR HINGE

(71) Applicant: MITSUI KINZOKU ACT CORPORATION, Yokohama-shi (JP)

(72) Inventor: Hiroshi Morinaga, Yokohama (JP)

(73) Assignee: MITSUI KINZOKU ACT CORPORATION (JP)

( * ) Notice: Subject to any disclaimer, the term of this patent is extended or adjusted under 35 U.S.C. 154(b) by 0 days.

(21) Appl. No.: 14/331,533

(22) Filed: Jul. 15, 2014

(65) Prior Publication Data

US 2015/0026924 A1 Jan. 29, 2015

(30) Foreign Application Priority Data

Jul. 26, 2013 (JP) ..... 2013-155435
Jul. 26, 2013 (JP) ..... 2013-155436

(51) Int. Cl.
*E05D 5/00* (2006.01)
*E05D 5/06* (2006.01)
*E05D 11/00* (2006.01)

(52) U.S. Cl.
CPC ..... *E05D 5/062* (2013.01); *E05D 2011/009* (2013.01)

(58) Field of Classification Search
USPC ..... 16/387, 386, 389, 261, 262, 263, 390; 29/11; 296/146.11, 146.12, 146.5, 296/146.9
See application file for complete search history.

(56) References Cited

U.S. PATENT DOCUMENTS

| | | | | |
|---|---|---|---|---|
| 5,950,295 | A * | 9/1999 | Worden et al. | 29/423 |
| 6,070,296 | A * | 6/2000 | Abeln et al. | 16/261 |
| 6,427,287 | B1 * | 8/2002 | Brueckner et al. | 16/342 |
| 7,076,836 | B1 * | 7/2006 | Butka | 16/342 |
| 7,469,446 | B1 * | 12/2008 | Brown et al. | 16/334 |
| 2003/0233732 | A1 * | 12/2003 | Kohlstrand et al. | 16/374 |
| 2004/0111833 | A1 * | 6/2004 | Janczak et al. | 16/221 |
| 2004/0231103 | A1 * | 11/2004 | Magnuson | 16/340 |
| 2006/0218749 | A1 * | 10/2006 | Brown et al. | 16/332 |
| 2006/0277718 | A1 * | 12/2006 | Nelson | 16/337 |
| 2010/0024164 | A1 * | 2/2010 | Machin et al. | 16/258 |

FOREIGN PATENT DOCUMENTS

| | | | |
|---|---|---|---|
| GB | 2055954 A | * | 3/1981 |
| JP | 59-30146 Y2 | | 8/1984 |

* cited by examiner

*Primary Examiner* — Chuck Mah
(74) *Attorney, Agent, or Firm* — Ostrolenk Faber LLP

(57) ABSTRACT

In a vehicle door hinge, a moving hinge member is fixed to a mounting surface of a door, and a fixed hinge member is fixed to a mounting surface of a vehicle body. The moving hinge member is pivotally mounted to the fixed hinge member via a hinge shaft. The fixed hinge member has a deformation-promoting portion which meets the mounting surface of the vehicle body at an intersection. An extension line extends from a facing side of the fixed hinge member facing the mounting surface of the door. First and second tangential lines which contact an outer circumference of the hinge shaft extend perpendicular the mounting surface of the vehicle body. The intersection is positioned between the extension line and the second tangential line remote from the extension line compared with the first tangential line. The facing side is formed at right angles or approximate right angles with respect to the mounting surface of the vehicle body, and the fixed hinge member is unfolded to a T-shape.

1 Claim, 10 Drawing Sheets

PRIOR ART

VEHICLE DOOR HINGE

TECHNICAL FIELD

The present invention relates to a vehicle door hinge for mounting a door to a vehicle pivotally.

BACKGROUND OF THE INVENTION

In FIG. 11, a vehicle door hinge comprises a fixed hinge member 101 pressingly molded of steel plate and fixed to a mounting surface B1 of a pillar B of a vehicle body; and a moving hinge member 104 pressingly molded of steel plate and pivotally connected to the fixed hinge member 101 via a hinge shaft 103.

The fixed hinge member 101 comprises a vehicle-body fixed portion 101*a* fixed to a mounting surface B1 of the pillar B with a bolt 105; a pair of bent portions 101*b* bent toward the outside of the vehicle or upward in FIG. 11 from a vehicle-body fixed portion 101*a* and having part through which the hinge shaft 103 is disposed; and a connecting portion 101*c* bent at an obtuse angle to the rear end of the vehicle-body fixed portion 101*a* and connecting upper and lower support portions 101*b* at the rear end as disclosed in JP59-30146Y.

However, in the vehicle door hinge, an intersection "a" of the connecting portion 101*c* to the vehicle-body fixed portion 101*a* of the fixed hinge member 101 is nearer to the front of the vehicle than the hinge shaft 103, and a rear end face 101*d* of the bent portion 101*b* is greatly tilted with respect to the mounting surface B1 of the pillar B. With deformation of the door D by side impact, a force is applied to the fixed hinge member 101 in a direction of an arrow, and the fixed hinge member 101 is greatly deformed at the intersection "a" as fulcrum.

In the conventional vehicle hinge device, the facing side 101*d* of the bent portion 101*b* of the fixed hinge member 101 is tilted with respect to the mounting surface B1 when seen axially of the hinge shaft 103, and the connecting portion 101*c* projects backward of the facing side 101*d*. In FIG. 12 in which the fixed hinge member 101 is unfolded, a pivot portion 101*f* in which the hinge shaft 103 is inserted is tilted with respect to a longitudinal direction of hoop material and the connecting portion 101*c* projects in a direction of width of the hoop material. The unfolded shape before press forming of the fixed hinge member 101 is larger laterally, so that yield is poor to hinder saving of the costs.

SUMMARY OF THE INVENTION

In view of the disadvantage, it is an object of the invention to provide a high-strength vehicle door hinge in which a fixed hinge member is deformed as little as possible.

It is another object of the invention to provide a vehicle door hinge with reduced manufacturing costs.

DETAILED DESCRIPTION OF PREFERRED EMBODIMENTS

Figure 1:
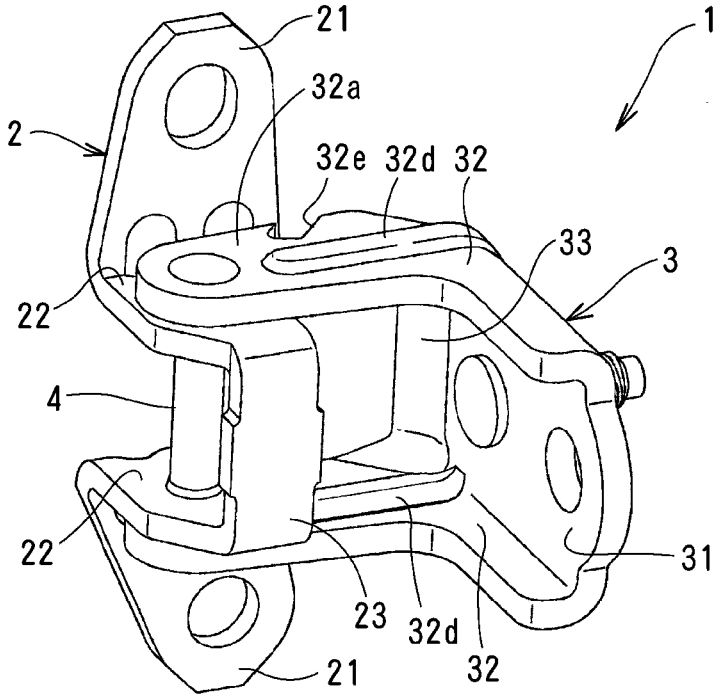
FIG. 1 is a perspective view of a vehicle door hinge according to the present invention.
Figure 2:
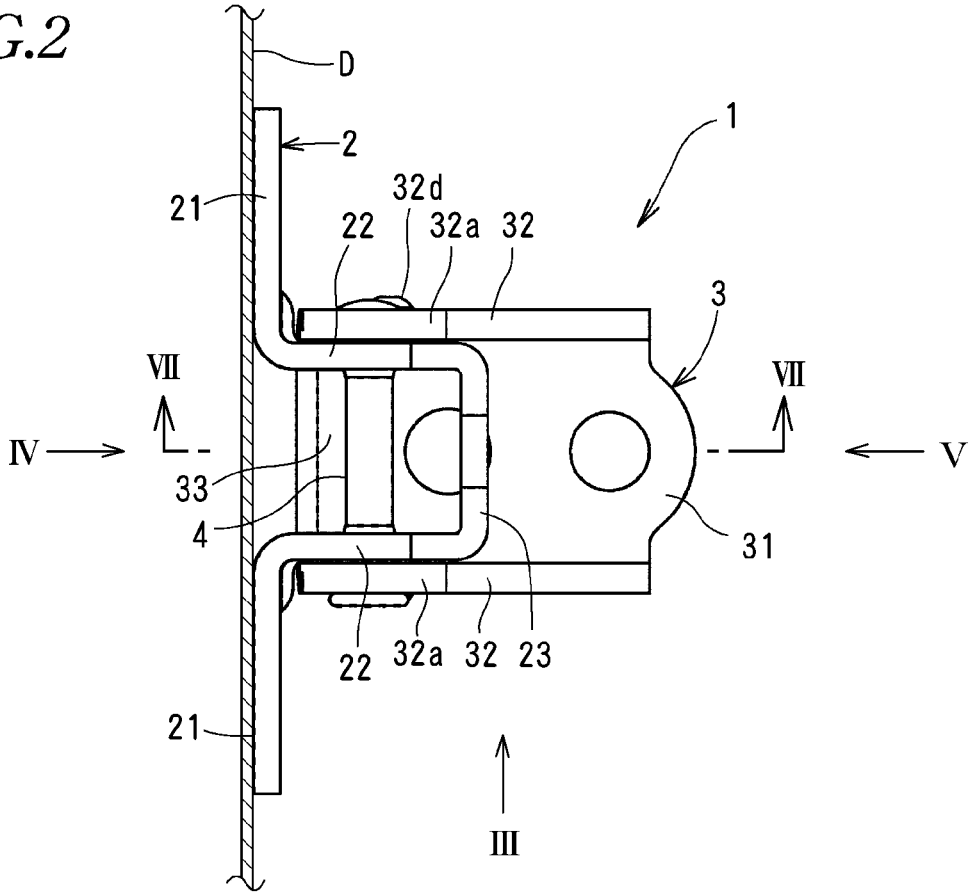
FIG. 2 is a front elevational view of the door hinge.

The best mode of the present invention will be described with respect to the drawings. In the following description, the left and the right in FIGS. 3 and 7-9 show the back and the front of a vehicle respectively, and the top and the bottom in FIGS. 3 and 7-9 show the outside and the inside of the vehicle respectively.

A door hinge 1 comprises a moving hinge member 2 fixed to the front end face of a door D and a fixed hinge member 3 fixed to a pillar B of a vehicle body. The moving hinge member 2 is pivotally mounted to the fixed hinge member 3 via a cylindrical vertical hinge shaft 4 with a brim, so that the door D is pivotally mounted to the pillar B.

The moving hinge member 2 is pressingly molded of steel plate, and comprises a pair of door-fixed portions 21,21 fixed to a mounting surface D1 or front end face of the door D, a pair of pivot portions 22,22 bent forward at right angles from each of the door-fixing portions 21,21 and perpendicular to the hinge shaft 4; and a connecting portion 23, in parallel with the hinge shaft 4, connecting the upper and lower pivot portions 22,22.

The fixed hinge member 3 is pressingly molded of steel plate, and comprises a vehicle-body fixed portion 31 fixed to the fixing surface B1 facing the outside of the vehicle, with a bolt 5 and a nut 6, a pair of bent portions 32,32 spaced from each other axially of the hinge shaft 4, an L-shaped corner 32*b* tilted at a predetermined angle to the vehicle-body fixed portion 31 in the bent portion 32, and a connecting portion 33 extending axially of the hinge shaft 4 to connect the corners 32*b*.

Figure 3:
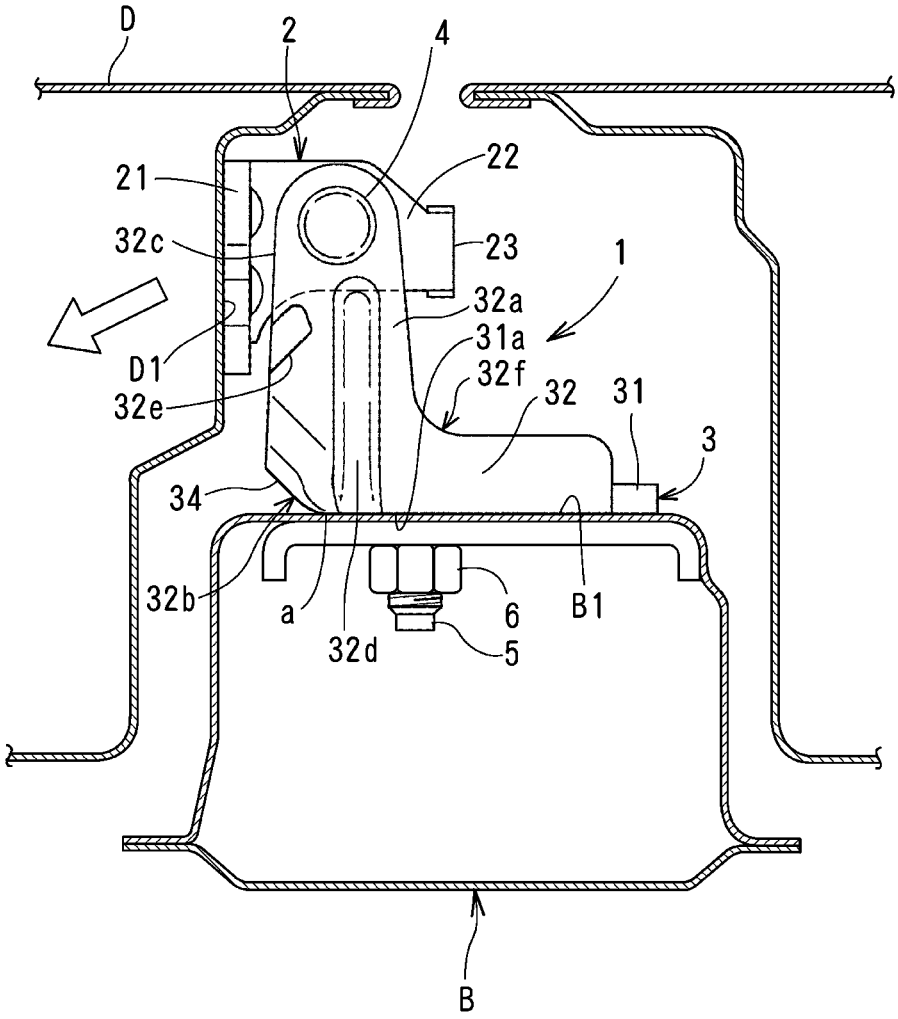
FIG. 3 is a view seen in a direction of an arrow III in FIG. 2.
Figure 4:
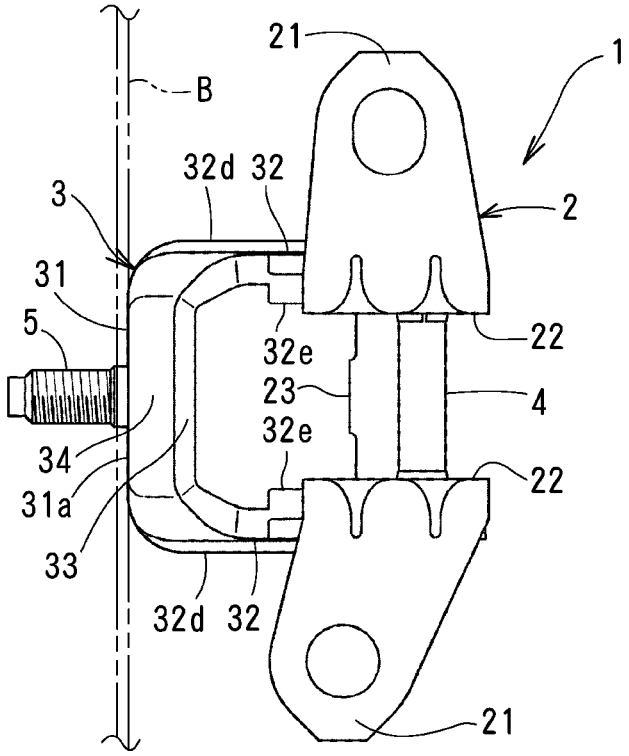
FIG. 4 is a view seen in a direction of an arrow IV in FIG. 2.
Figure 5:
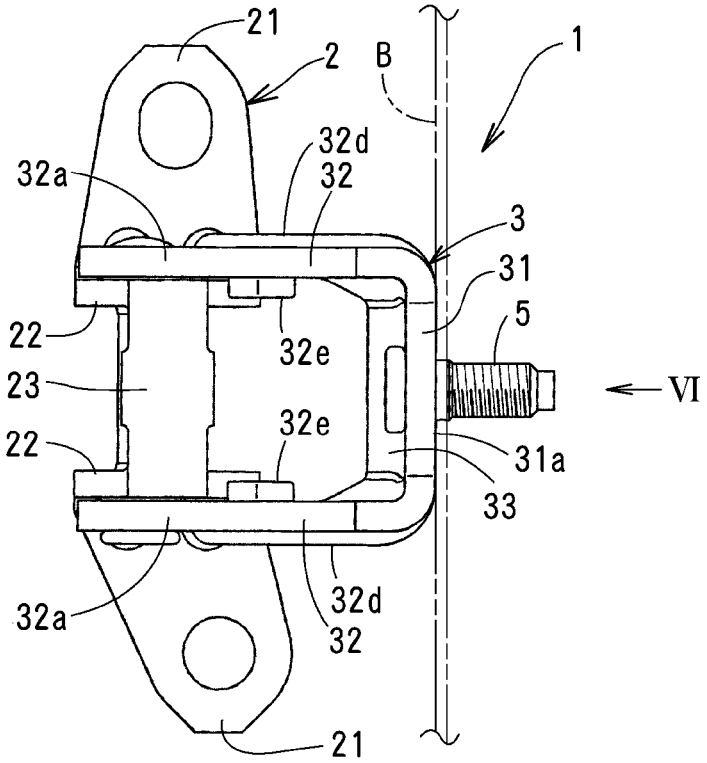
FIG. 5 is a view seen in a direction of an arrow V in FIG. 2.
Figure 6:
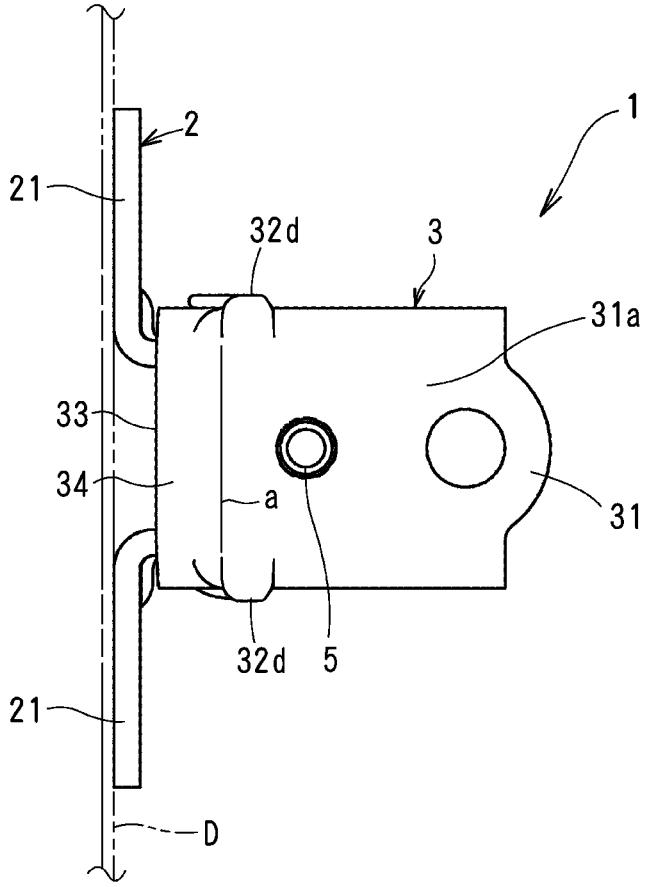
FIG. 6 is a view seen in a direction of an arrow VI in FIG. 5.
Figure 7:
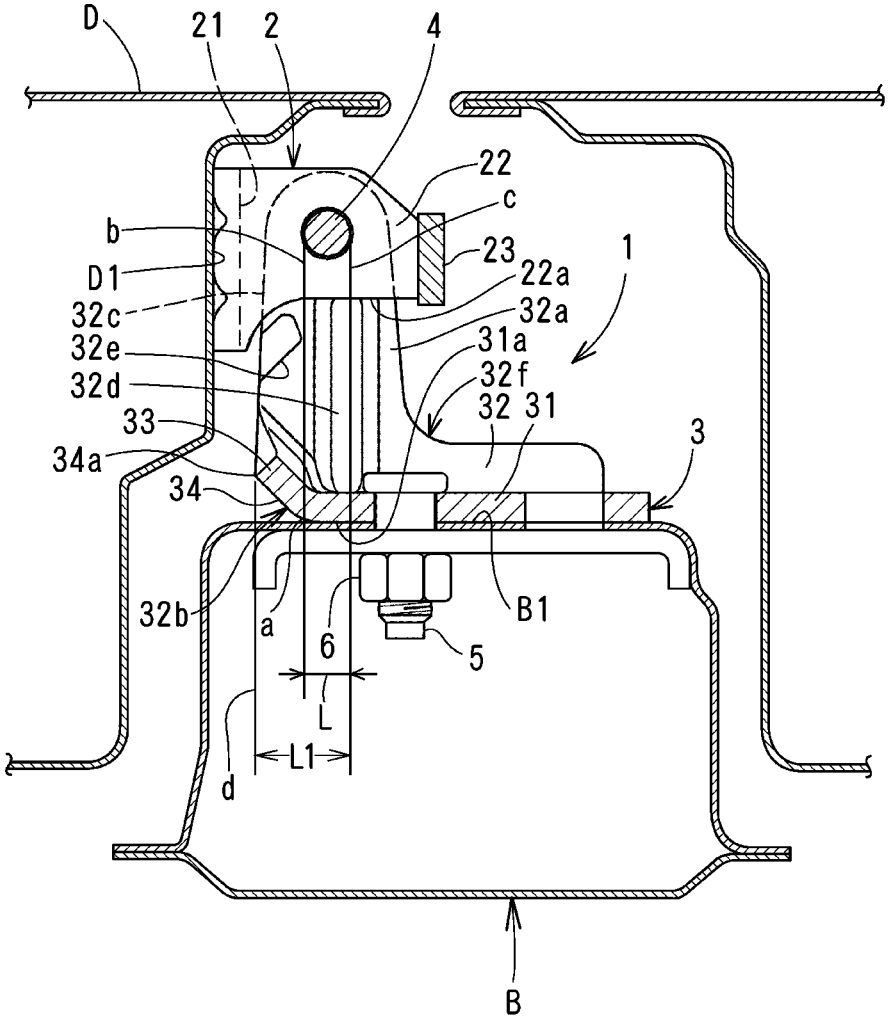
FIG. 7 is a horizontal sectional view taken along the line VII-VII in FIG. 2.
Figure 8:
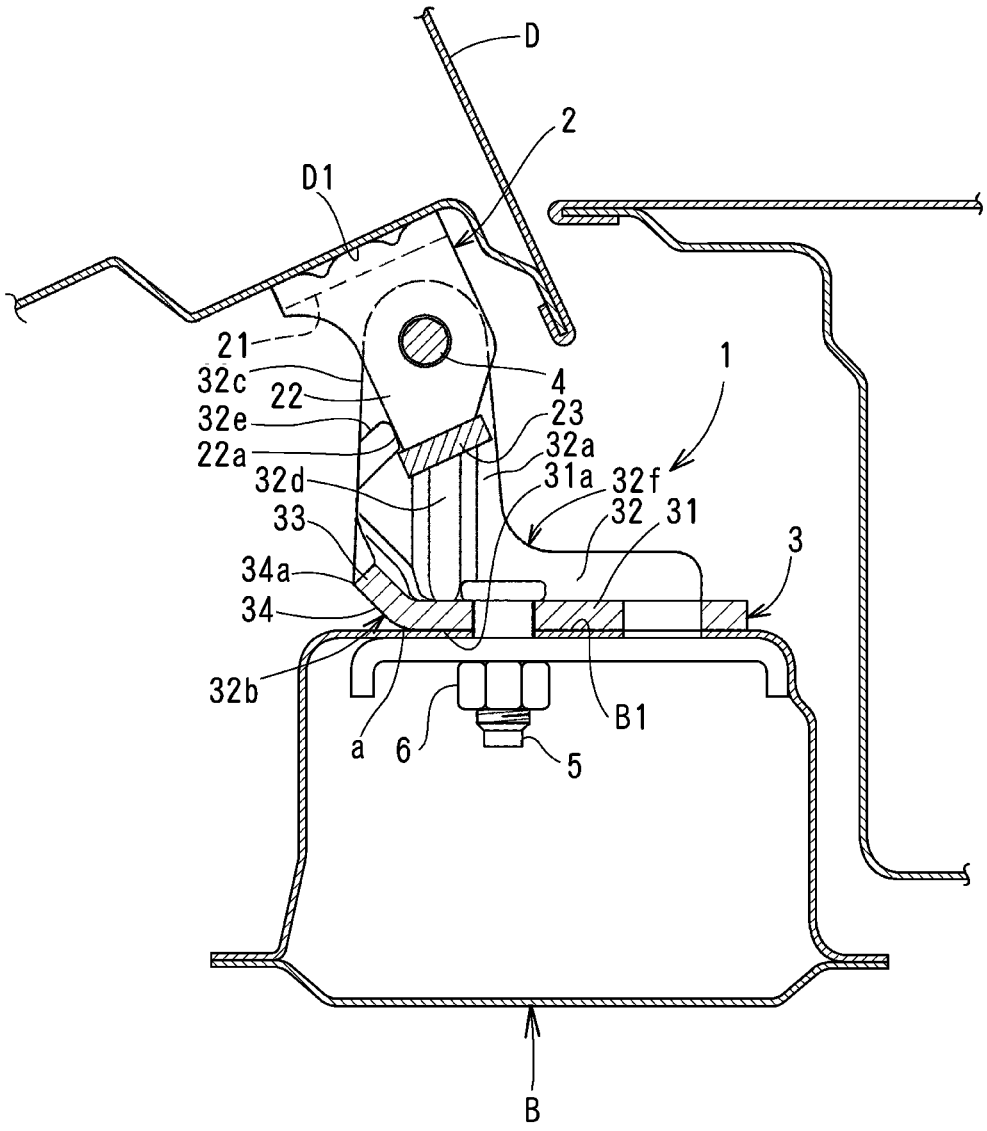
FIG. 8 is a horizontal sectional view similar to FIG. 7 when a door is fully open.

The bent portion 32 is like an L when seen axially of the hinge shaft 4 in FIGS. 3, 7 and 8, and a pivot portion 32*a* extending backward at the rear part of the bent portion 32. The pivot portion 22 of the moving hinge member 2 is pivotally mounted to the pivot portion 32*a* via the hinge shaft 4.

When seen axially of the hinge shaft 4, a facing side 32*c* or back end face of the pivot portion 32*a* at the bent portion 32 is formed with respect to the mounting surface B1 of the pillar B at right angles or approximately right angles such as 87 degrees in this embodiment. The back end face of the pivot portion 32*a* faces the mounting surface D1 of the door D when the door D is closed.

In order to improve rigidity of the bent portion 32, on the upper surface of the upper bent portion 32 and on the lower surface of the lower bent portion 32, there is formed a projection 32*d* which extends straight from an edge at which the bent portion 32 meets the vehicle-body fixed portion 31. In FIG. 8, on the lower surface of the upper bent portion 32 and on the upper surface of the lower bent portion 32, there is provided a stopper 32*e* which contacts an end face 22*a* of each of the pivot portions 22 of the moving hinge member 3 to hold the door D at a full-open position.

A connecting portion 33 is formed at the back part of the vehicle-body fixed portion 31 and connects the upper bent portion 32 to the lower bent portion 32 at a corner 32*b* and its vicinity thereby improving bending strength along thickness the bent portion 32 or vertically.

The corner 32*b* of the bent portion 32 and the connecting portion 33 are tilted at a predetermined angle such as 40 degrees in this embodiment with respect to the mounting surface B1 of the pillar B and is not normally in contact with the mounting surface B1 of the pillar B. The bent portion 32 is deformed to enlarge the angle of an internal corner 32*f* of the L-shape to form a deformation-promoting portion 34 which can contact the mounting surface B1.

In FIG. 7, an intersection "a" at which the deformation-promoting portion 34 contacts a vehicle-body contact surface 31*a* of the vehicle-body fixed portion 31 is positioned in a hinge-shaft diameter region L equal to the diameter of the hinge shaft 4. The deformation-promoting portion 34 is tilted to gradually go away from the mounting surface B1 of the pillar B from the intersection "a". An rear end 34*a* is positioned on a facing side 32*c* of the pivot portion 32*a* of each of the bent portions 32 of the fixed hinge member 3 behind the hinge-shaft diameter region L so that the rear end does not project from the facing side 32*c* backward.

In FIG. 7, when seen axially of the hinge shaft 4, the hinge-shaft diameter region L is defined as a region between lines which extend perpendicular to the mounting surface B1 from tangential lines "b" and "c" which contact an outer circumference of the hinge shaft 4.

The deformation-promoting portion 34 is not normally in contact with the mounting surface B1. If the fixed hinge member 3 is deformed with deformation of the door D in FIG. 9, the deformation-promoting portion 34 comes in contact with the mounting surface B1.

Figure 9:
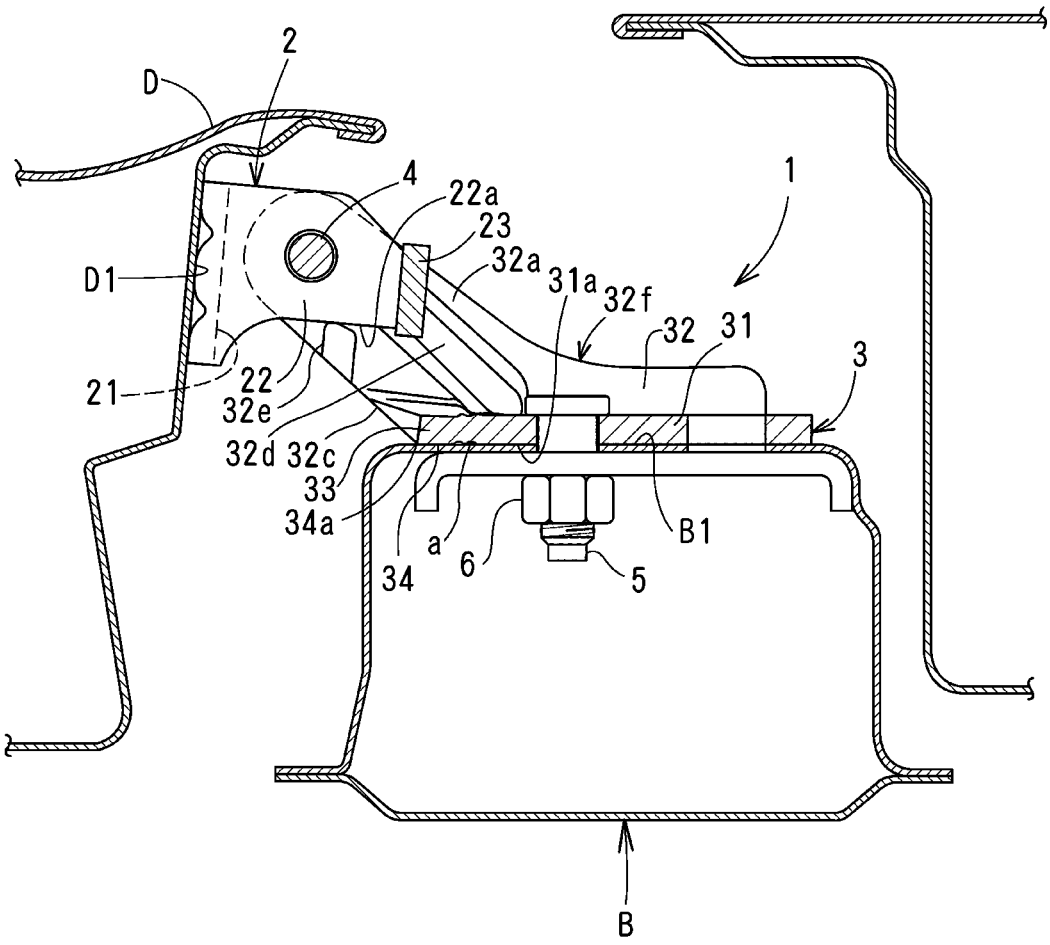
FIG. 9 is a horizontal sectional view similar to FIG. 7 when the door hinge is deformed.

Explaining deformation of the fixed hinge member 3 in detail, the deformation-promoting portion 34 is not normally in contact with the mounting surface B1. Owing to side impact on the door D, the door D is deformed toward the inside of the vehicle. The moving hinge member 2 is pulled in obliquely backward in a direction of an arrow in FIG. 3. Before the deformation, since the deformation-promoting portion 34 is not in contact with the mounting surface B1 of the pillar B, the bent portion 32 is deformed such that the angle at the L-shaped inner corner 32*f* is enlarged at the intersection "a" as fulcrum between the deformation-promoting portion 34 and the vehicle-body contacting surface 31*a*. In deformation, the intersection "a" is positioned within the hinge-shaft diameter region L, and the bent portion 32 cannot easily be deformed compared with the prior art. In FIG. 9, the bent portion 32 is deformed at some extent, and the deformation-promoting portion 34 comes in contact with the mounting surface B1. So the bent portion 32 is prevented from being further deformed. It prevents the vehicle-body fixed portion 31 of the fixed hinge member 3 from turning up the mounting surface B1 and prevents the internal corner 32*f* from being ruptured suddenly owing to stress concentration thereby improving strength of the door hinge 1 and enabling the door D to be supported more firmly.

It will be described with respect to an unfolded view of the fixed hinge member 3 before steel-plate press forming.

Figure 10:
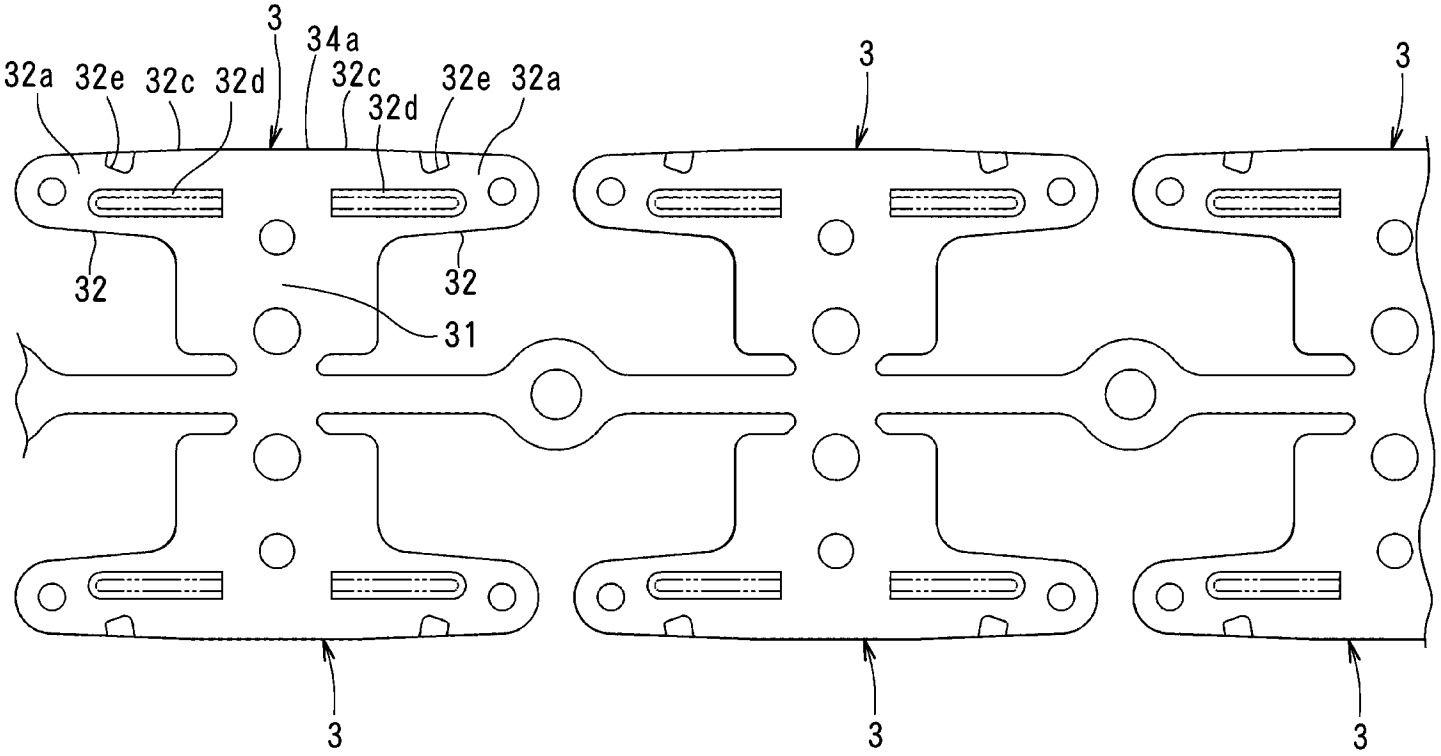
FIG. 10 is an unfolded view of a fixed hinge member before press forming.
Figure 11:
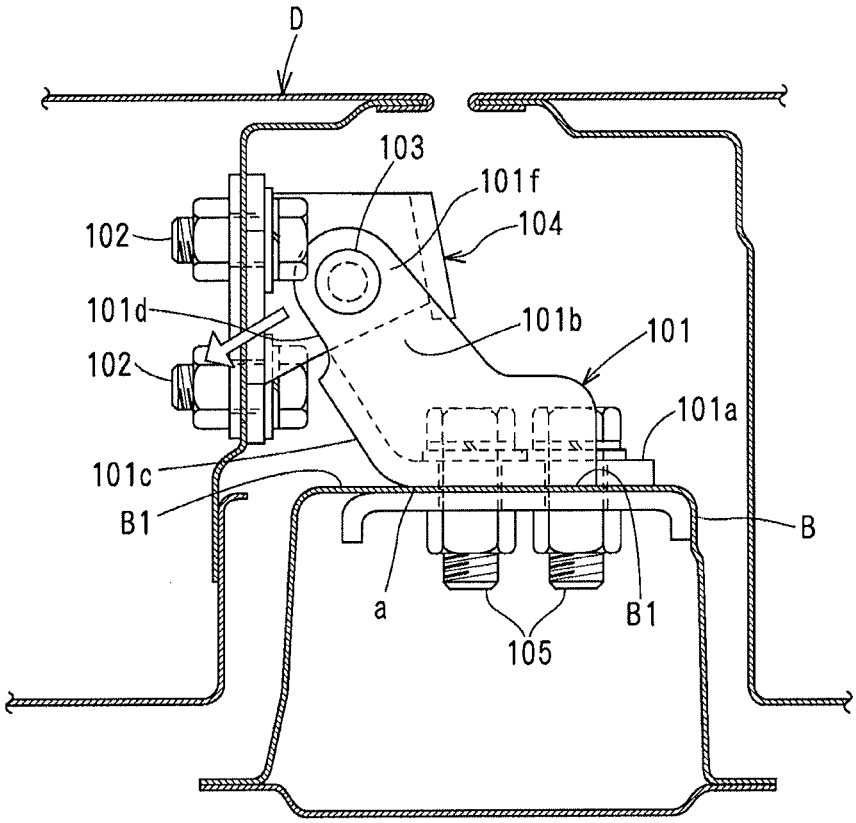
FIG. 11 is a top plan view of a door hinge in the prior art.
Figure 12:
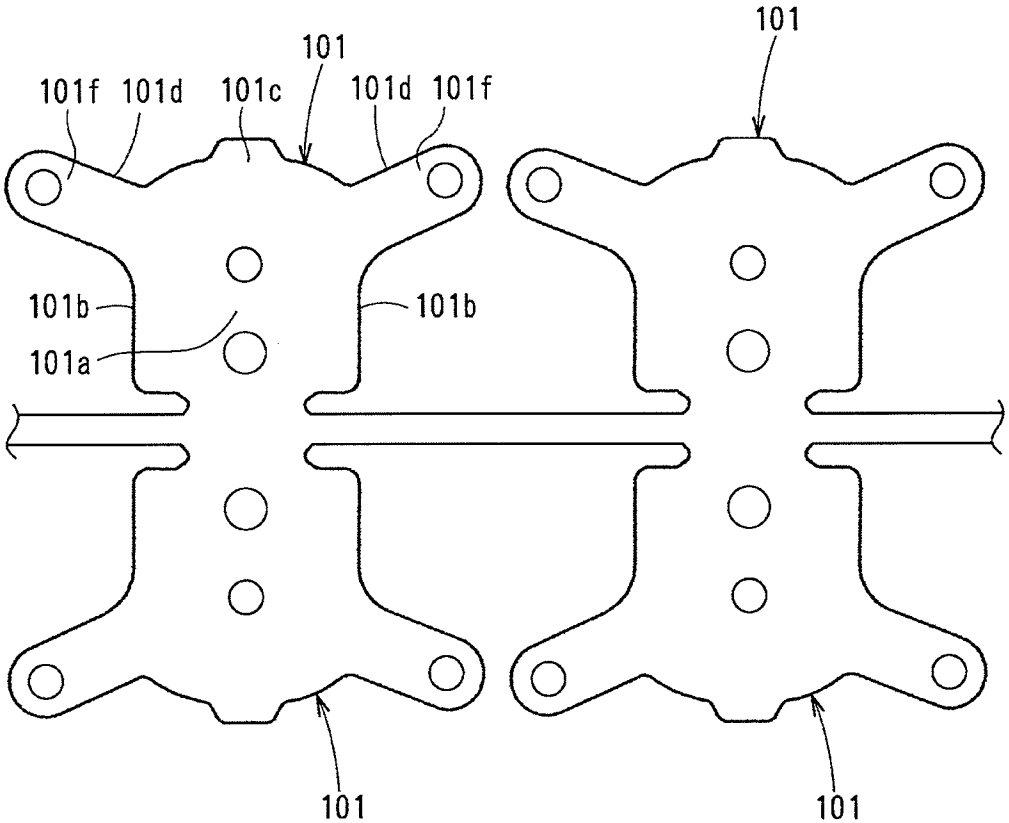
PRIOR ART FIG.12
FIG. 12 is an unfolded view of a fixed hinge member in the prior art.

As mentioned above, when seen axially of the hinge shaft 4, the facing side 32*c* of the bent portion 32 of the fixed hinge member 3 is positioned at approximately right angles with respect to the mounting surface B1 of the pillar "B", and the rear end 34*a* of the connecting portion 33 is positioned on an extension line of the facing side 32*c* without projecting backward. In FIG. 10, in the unfolded view of the fixed hinge member 3, the pivot portion 32*a* of the bent portion 32 extends straight longitudinally of a hoop material or vertically in FIG. 10, and the vehicle-body fixed portion 31 extends perpendicular to the middle of the pivot portion 32*a* along a width of the hoop material or a right and left direction in FIG. 10 like a T.

The fixed hinge member 3 in this embodiment is like a T in the unfolded view to improve yield and save the costs.

In this embodiment, the deformation-promoting portion 34 is formed all over the tilted surface of the connecting portion 33, but this invention is not limited thereto. The deformation-promoting portion 34 prevents the bent portion 32 from being deformed by contacting the mounting surface B1 of the pillar B. An L-shaped corner 32*b* is formed at least on the bent portion 32, and similar advantage to this embodiment is gained.

The foregoing relates to the embodiments of the present invention. Various changes and modifications may be made without departing from the scope of claims.

(i) The door D to which the present invention applies is a tailgate and a sliding door of a vehicle.

(ii) The number of the bolt 5 for fixing the fixed hinge member 3 is more than one.

(iii) In FIG. 7, the facing side 32*c* of the bent portion 32 which faces the mounting surface D1 of the door D extends toward the mounting surface B1 of the pillar B of the vehicle body to form the extension line "d". A limited region L1 is defined as a region between the extension line "d" and the tangential line "c". The deformation-promoting portion 34 is set such that the intersection "a" between the vehicle-contact surface 31*a* and the mounting surface B1 of the pillar B is positioned in the limited region L1. Similar advantage to the foregoing embodiment is gained.

(iv) The bent portion 32 of the fixed hinge member 3 is formed on the upper end or lower end of the vehicle-body fixed portion 31.

What is claimed is:

1. A vehicle door hinge comprising:

a moving hinge member fixed to a first mounting surface of a door;

a hinge shaft via which the moving hinge member is pivotally mounted; and a fixed hinge member pressingly molded of steel plate and fixed to a second mounting surface of a vehicle body, the moving hinge member being pivotally mounted to the fixed hinge member via the hinge shaft, the fixed hinge member comprising a vehicle-body fixed portion fixed on the second mounting surface with a bolt, a pair of L-shaped bent portions each of which is formed at ends spaced axially of the hinge shaft, a corner of the bent portion tilted at a predetermined angle with respect to the vehicle-body fixed portion, and a connecting portion extending axially to connect the corners and its vicinities to each other, a fixed hinge member fixed to a second mounting surface of a vehicle body, the moving hinge member being pivotally mounted to the fixed hinge member via the hinge shaft, the fixed hinge member comprising a vehicle-body fixed portion fixed to the second mounting surface, and an L-shaped bent portion bent at approximate right angles with respect to the second mounting surface, wherein the bent portion has a deformation-promoting portion that is not normally in contact with the second mounting surface and is capable of contacting the second mounting surface when the bent portion is deformed by an impact, and wherein a hinge-shaft diameter region is defined as a region between a first tangential line and a second tangential line, both of the first and second tangential lines contacting an outer circumference of the hinge shaft and extending toward the second mounting surface perpendicular to the second mounting surface, an extension line extending toward the second mounting surface from a facing side of the bent potion facing the first mounting surface, a limited region being defined as a region between the extension line and the second tangential line remote from the extension line compared to the first extension line, an intersection being a point at which the deformation-promoting portion meets the second mounting surface, the intersection being positioned within the hinge-shaft diameter region of the limited region, the deformation-promoting portion being tilted gradually away from the second mounting surface from the intersection, wherein a facing side of each of the pair of L-shaped bent portions which faces the first mounting surface is formed at right angles or approximately right angles with respect to the second mounting surface, whereby the fixed hinge member has a T-shape when it is unfolded, and wherein an end face of the connecting portion does not extend be and the extension line toward the first mounting surface when seen axially of the hinge shaft.

* * * * *